US006094496A

United States Patent [19]

Stowers, Sr.

[11] Patent Number: 6,094,496

[45] Date of Patent: Jul. 25, 2000

[54] VEHICLE SEAT HEADREST INCORPORATING SPEAKERS AND AN EXTENSIBLE/RETRACTABLE MICROPHONE

[76] Inventor: Duane B. Stowers, Sr., 4871 20th Ave. S., Seattle, Wash. 98108

[21] Appl. No.: 09/185,136

[22] Filed: Nov. 3, 1998

Related U.S. Application Data

[63] Continuation-in-part of application No. 08/912,994, Aug. 18, 1997, abandoned.

[51] Int. Cl.[7] ..... H04R 25/00

[52] U.S. Cl. ..... 381/362; 381/361; 381/365

[58] Field of Search ..... 381/355, 361, 381/362, 363, 365, 366, 368, 71.6, FOR 147, FOR 148

[56] References Cited

U.S. PATENT DOCUMENTS 4,215,250 7/1980 Resener ..... 381/362

4,977,600 12/1990 Ziegler ..... 381/71.6

*Primary Examiner*—Huyen Le

*Attorney, Agent, or Firm*—Robert Jenny

[57] ABSTRACT

A vehicle seat backrest incorporates two speakers and an electrically driven extensible/retractable boom carrying a microphone. The boom is supported and guided in grooves in the casing of the extension/retraction assembly. It is constructed of two spring metal straps having arcuate cross section shapes and a flexible insulation layer between the straps. The straps serve as electrical conductors for the microphone and electrical signals are transmitted to and from the straps by brushes. The boom is activated by connection to a toothed belt carried on two toothed pulleys, one of which is driven by an electric motor. The headrest is used with a commercially available cellular telephone having a jack into which the microphone and speakers of the backrest are plugged.

1 Claim, 2 Drawing Sheets

VEHICLE SEAT HEADREST INCORPORATING SPEAKERS AND AN EXTENSIBLE/RETRACTABLE MICROPHONE

This application is a Continuation-In-Part of application Ser. No. 08/912,994, filed Aug. 18, 1997, to be abandoned when this application is duly filed.

BACKGROUND OF THE INVENTION

1. Field

The subject invention is in the field of radio telephone and cellular telephone communication equipment designed to allow essentially hands free operation of the telephone, particularly in a vehicle. More specifically, it is in the field of apparatus used to position a microphone in the vicinity of a user's mouth when necessary and to stow the microphone and its support when the microphone is not needed.

2. Prior Art

U.S. Pat. No. 4,215,250 shows prior art in this specific field. The mechanism of '250 mounts above the vehicle door adjacent to the intended user of the mechanism and a microphone is carried on the end of a boom which is extensible/retractable and angularly adjustable. Also, there is a speaker in the mechanism. The extension and angular adjustment of the boom are done manually and retraction occurs when a knob that controls the volume of the speaker is pressed. The mechanism of this microphone support is considered to be quite complex and therefore expensive. Also, the manual adjustment detracts from the goal of hands off operation. If this microphone support is used with a cellular telephone, it would be necessary to manually operate the telephone which would require using both hands unless the telephone is mounted in a suitable bracket. U.S. Pat. Nos. 4,060,697 and 4,151,468 show brackets used in vehicles to hold microphones and these brackets could be used to hold a cellular telephone. The boom is made of springy, non-electrically conductive material and has an arcuate cross section shape similar to that used in extensible-retractable tape measures. This shape allows the extended portion of the boom to be straight and allows the boom to wrap around guides, pulleys, etc., for storage upon retraction. Conductors embedded in the boom connect the microphone electrically into the communication system.

There is commercially available prior art pertinent to the subject invention, comprising a cellular phone having a jack into which a microphone and/or headphones can be plugged. Use of such a microphone and headphones would contribute significantly to hands free operation of a cellular telephone. However, it would be inconvenient to put the headphones on and off each time a call was made or received.

Another prior art technique for providing relatively hands free operation of radio or cellular telephone communication in a vehicle is to use speakers and/or microphones and audio volume levels which do not require the microphone to be near a user's mouth or speakers near the user's ears. However, in such a situation audio fidelity would be low and interference from noises in the environment would be high.

In view of the discussed prior art the primary objective of the subject invention is to provide equipment which allows essentially hands free and high fidelity cellular telephone usage in a vehicle, requiring no manual extension, retraction or positioning of a microphone or donning and removing a headset. Other objectives that the equipment be relatively simple, reliable and inexpensive.

SUMMARY OF THE INVENTION

The subject invention is a headrest, mounted on the top of the back of a vehicle seat and incorporating two speakers and an automatically extensible/retractable microphone. Switching is provided so that the speakers can be connected to the radio in the vehicle or to a cellular telephone. The microphone is attached to the end of a boom. The boom comprises two spring metal straps, each having an arcuate cross section shape, and an elastomeric strap which electrically insulates the metal straps from each other. The edges of the boom slide in grooves in the housing of the microphone extension/retraction assembly in the headrest. The boom is actuated by an endless belt which is carried on two cogwheels and driven by an electric motor connected to one of the cogwheels. The metal strap adjacent to the belt is attached to the belt at the strap end opposite the strap end to which the microphone is attached. The straps are the electrical conductors for the microphone and the electrical signals are provided to the straps by brushes. One or both brushes may be retractable and be retracted when the microphone is being moved to reduce the power required for moving the microphone.

The subject invention is preferably used with a commercially available cellular telephone which incorporates a jack into which the speakers in the headrest and the microphone can be plugged. The amount of extension of the microphone is controlled by a limit switch, the position of which is adjusted to set the desired amount of microphone extension.

In preferred usage the cellular phone is mounted in a bracket and positioned close to the user's line of sight while driving. The switches for controlling the microphone extension and retraction are mounted on this bracket. Alternately, the activation of the microphone extension and retraction can be automated in response to specific telephone signals. The switch for connecting the headrest speakers to the telephone or the vehicle's audio system can also be mounted on this bracket or that interconnection could also be automated.

For non-automated use for an incoming call the user presses the switch to extend the microphone, the switch to connect the speakers to the telephone and a button on the phone to receive the call. When the call is completed the user pushes the end button on the telephone, the microphone retract button and, if desired, the speaker interconnect button. The procedure is essentially the same for an outgoing call except that the call must be dialed instead of a button being touched. Alternately, voice actuated dialing could be used to further reduce hand use requirements.

The invention is described in more detail below with reference to the attached drawings.

DETAILED DESCRIPTION OF THE INVENTION

Figure 1:
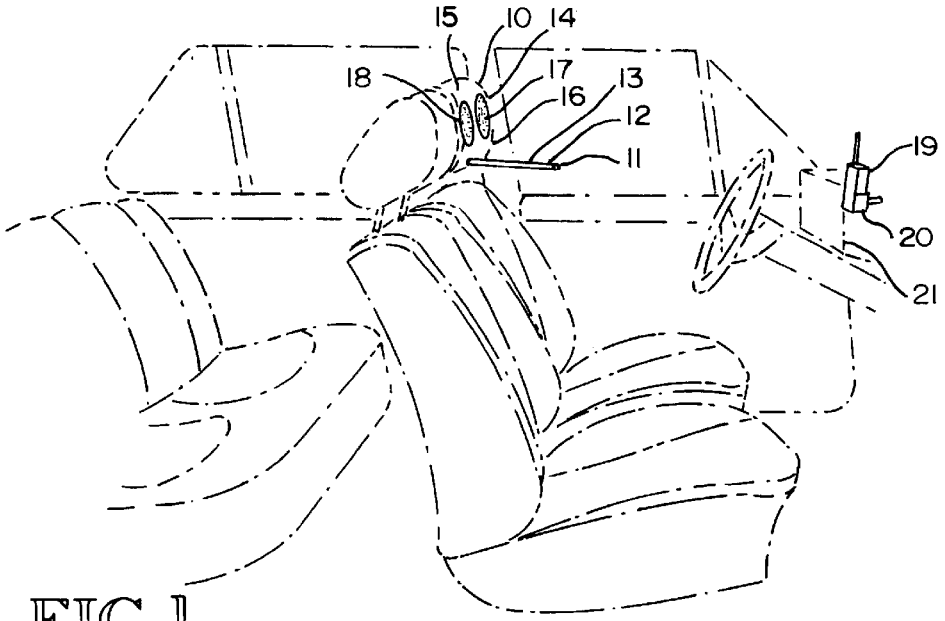
FIG. 1 is a general view of an installation of the subject invention.

The subject invention is a vehicle seat headrest incorporating speakers and an extendible/retractable microphone. The headrest 10 is shown in FIG. 1 with microphone 11 attached at the end 12 of extended boom 13. Speakers 14 and 15, not visible, are in the headrest casing 16 behind perforated surfaces 17 and 18 respectively. Cellular telephone 19 is mounted in bracket 20 on dashboard 21.

Figure 2:
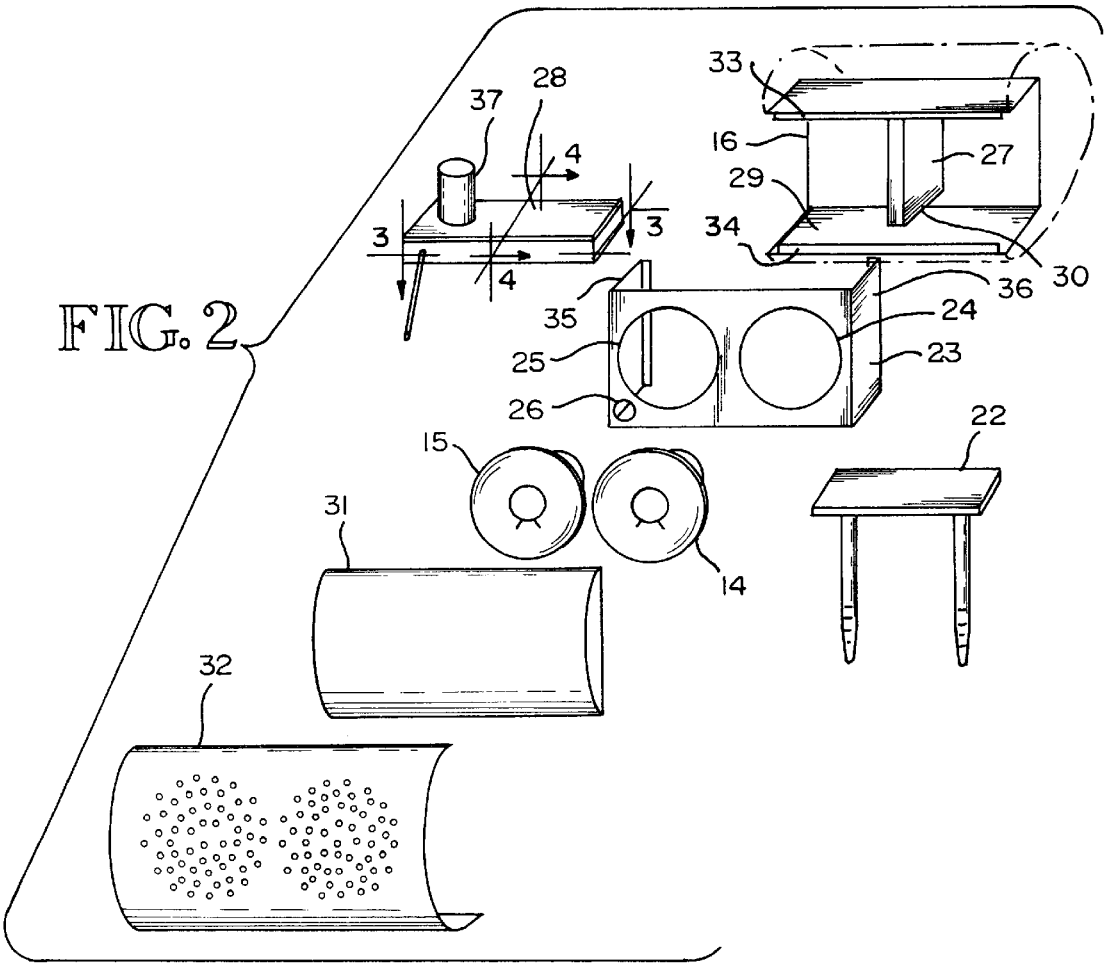
FIG. 2 is a semi-schematic exploded view of the headrest assembly.

FIG. 2 is a semi-schematic exploded view of the headrest assembly. Casing 16 is attached to mounting assembly 22 which is adapted to suit the vehicle seat on which the headrest is to be used. The mounting details are conventional. Panel 23 covers the front and sides of the casing. Speakers 14 and 15 are mounted in openings 24 and 25 and boom 13 fits through hole 26. Partition 27 separates the space inside the headrest into two cavities, one for each speaker. Microphone extension/retraction assembly 28 rests on surface 29 under edge 30 of the partition. Porous foam padding 31 is attached to panel 23 and perforated covering 32 is attached to edges 33 and 34 of casing 16 and ends 35 and 36 of panel 23 over the foam and extends around the headrest. Motor 37 powers the extension and retraction of the microphone.

Figure 3:
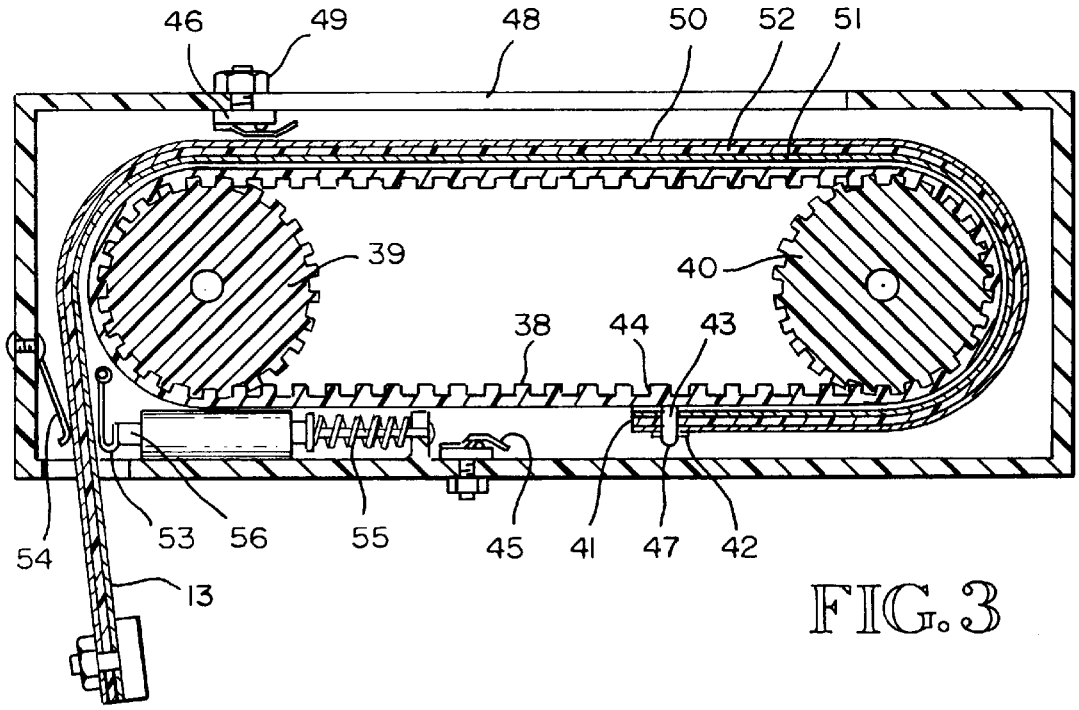
FIG. 3 is a semi-schematic sectional view taken at 3—3 in FIG. 2 showing details of the boom extension/retraction mechanism.

FIG. 3 is a sectional view taken at 3—3 in FIG. 2. Toothed belt 38 is supported on drive cogwheel 39 and idler cogwheel 40. Drive cogwheel 39 is driven by motor 37. End 41 of boom 13 is attached by fastener 42 to fitting 43. Fitting 43 has a flexible base 44 and is attached by adhesive to the belt. The boom is guided by and supported in grooves (described below) and extends and retracts in response to rotation of cogwheel 39. The limits of travel of the boom are controlled by switches 45 and 46 which are activated by protrusion 47 on fitting 43. Contact of switch 45 limits retraction of the boom. Contact of switch 46 limits extension of the boom. The position of switch 46 is adjustable. It is attached in a slot 48 by nut 49. Adjustment is made by loosening the nut, moving the switch and tightening the nut. The boom comprises two metal straps 50 and 51 separated by an insulation layer 52 adhesively attached to strap 50. Brushes 53 and 54 contact straps 50 and 51 respectively to provide electrical signals to the microphone. Spring 55 presses solenoid core piece 56 against brush 53 and brush 53 against strap 50 and presses, through brush 53 and the boom, strap 51 against brush 54. When electrical power is provided to motor 37 it is also provided to solenoid 59 which moves against the force of the spring to take pressure off the brushes. This allows use of a smaller motor, reduces wear on the brushes and eliminates electrical noise in the signals from the microphone while the boom is moving.

Figure 4:
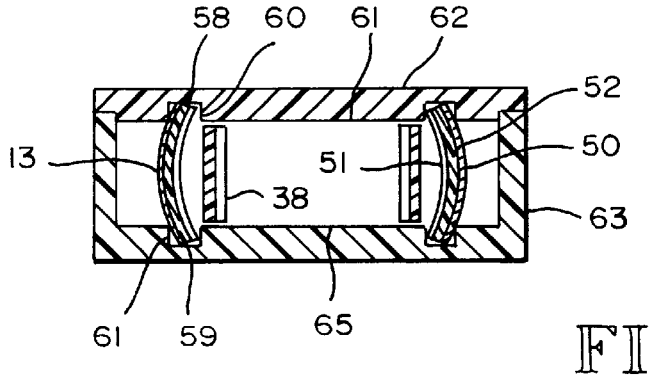
FIG. 4 is a semi-schematic section taken at 4—4 in FIG. 2, showing the boom retention and guidance grooves and cross section details of the boom.

FIG. 4 is a section taken at 4—4 in FIG. 2. Edges 58 and 59 of boom 13 engage grooves 60 and 61 respectively, groove 60 being in cover 62 and groove 61 being in casing 63 of the microphone extension/retraction assembly 30. Belt 38 moves between surfaces 64 and 65.

It is considered to be understandable from this description that the subject invention can be made and used by persons of ordinary skills in the art based on the information in the description and that the subject invention meets its objectives. It provides equipment which allows essentially hands free cellular telephone usage in a vehicle without requiring manual extension, retraction or positioning a microphone or use of a headset. It provides high fidelity performance even in vehicle environment because the speakers are close to the user's ears. The equipment is simple and therefore easily made, reliable and inexpensive.

I claim:

1. A headrest for a vehicle seat, said headrest incorporating two speakers, a microphone, an extensible/retractable boom and an electrically driven extension/retraction assembly, said boom being attached to and driven by said extension/retraction assembly, and said microphone being attached to said boom, said boom comprising first and second spring metal straps and a flexible insulating layer, each of said straps having an arcuate cross section shape, said straps being separated by said insulation layer, said extension/retraction assembly comprising a casing having an opening, a drive cogwheel, an idler cogwheel, a toothed belt and an electric motor, said boom being slidably mounted in said casing and extending through said hole, said drive cogwheel being driven by said electric motor, said belt being carried on said drive and idler cogwheels and driven by said drive cogwheel.

* * * * *